US006254723B1

(12) United States Patent
Snekkenes et al.

(10) Patent No.: US 6,254,723 B1
(45) Date of Patent: Jul. 3, 2001

(54) METHOD FOR CONTINUOUS COOKING IN A SINGLE-VESSEL DIGESTER

(75) Inventors: Vidar Snekkenes; Lennart Gustavsson, both of Karlstad (SE)

(73) Assignee: Kvaerner Pulping AB (SE)

( * ) Notice: Subject to any disclaimer, the term of this patent is extended or adjusted under 35 U.S.C. 154(b) by 0 days.

(21) Appl. No.: 09/445,884

(22) PCT Filed: Jun. 13, 1997

(86) PCT No.: PCT/SE97/01039

§ 371 Date: Dec. 13, 1999

§ 102(e) Date: Dec. 13, 1999

(87) PCT Pub. No.: WO98/56979

PCT Pub. Date: Dec. 17, 1998

(51) Int. Cl.[7] ..... D21C 7/14
(52) U.S. Cl. ..... 162/43; 162/45; 162/248
(58) Field of Search ..... 162/18, 19, 21, 162/45, 246, 247, 43, 47, 248

(56) References Cited

U.S. PATENT DOCUMENTS

| | | | |
|---|---|---|---|
| 2,876,098 | 3/1959 | Schandroch | 92/6 |
| 5,302,247 | 4/1994 | Richardsen et al. | 162/42 |

FOREIGN PATENT DOCUMENTS

| | | |
|---|---|---|
| WO 94/23120 | 10/1994 | (WO) . |
| WO 96/34143 | 10/1996 | (WO) . |

*Primary Examiner*—Dean T. Nguyen
(74) *Attorney, Agent, or Firm*—Fasth Law Offices; Rolf Fasth

(57) ABSTRACT

In a single-vessel system for continuous cooking of kraft pulp, chips and liquor are conveyed from a high pressure feeder in a transfer line to a first end of a digester. A part of the liquor is separated from the chips that are withdrawn from an outlet defined in an upper part of the digester and conveyed in a return line to the high pressure feeder. A constituent flow of liquor is led from the return line and heated and fed via one or more inlets into the digester at a location that is downstream of the outlet for the return line.

9 Claims, 1 Drawing Sheet

METHOD FOR CONTINUOUS COOKING IN A SINGLE-VESSEL DIGESTER

TECHNICAL FIELD

The present invention relates to a method for continuous cooking of cellulose-containing fiber material, preferably by the kraft process, in a single-vessel system with the purpose of achieving good pulp strength, but in a preferred embodiment also for the purpose of achieving relatively low energy consumption. The invention can be used expediently for conversion of old single-vessel digesters and may include black liquor impregnation.

BACKGROUND AND SUMMARY OF THE INVENTION

In existing single-vessel kraft digesters, especially hydraulic digesters, there are sometimes problems which concerns difficulties in obtaining a uniform cooking. In order to achieve a uniform and selective cooking, it is desirable to be able to impregnate the chips in the upper part of the digester with hot liquor, possibly including black liquor, which has a relatively high content of sulfide ions and a low content of hydroxide ions. However, a high temperature at the top of the digester leads to a high temperature in the transfer circulation which conveys the chips from a so-called high-pressure feeder, that is to say a pressure sluice which transfers the chips together with liquid from a low-pressure system to a high-pressure system. Thereafter, the liquid is in the main separated from the chips with the aid of a top separator at the top of the digester and is returned to the high-pressure feeder. If this returned liquid has a temperature which exceeds the boiling point in the low-pressure system, the liquid will flash in the high-pressure feeder, said flashing manifesting itself in the form of bangs.

From WO 94/23120 (Collins) it is known to thermally insulate the high-pressure feeder from the digester by means of replacing a first, relatively cold liquid with a second, relatively hot liquid outside the digester, in the transfer line from the high-pressure feeder to the digester. This change of liquids is preferably carried out with the aid of a free-standing, upward-feeding top separator. The first, relatively cold liquid is returned to the high-pressure feeder, as a result of which a first circulation is obtained within the transfer circulation. The second, relatively hot liquid consists to a large extent of liquid from the top of the digester, which liquid is further heated up before being supplied to the liquid exchanger. By means of the return of liquid from the top of the digester to the liquid exchanger, a second circulation is obtained within the transfer circulation.

From WO 96/34143 (Oulie et al.) is known a method similar to that of WO 94/23120 but including black liquor impregnation by addition of hot black liquor to the second circulation.

Both of the methods described in these two WO-applications are well functioning methods. They have, however the draw-back of requiring the installation of a relatively expensive liquid exchanger which might include the risk of clogging.

The object of the present invention is to provide an improved method for continuous cooking of fiber-containing cellulose material, preferably softwood, which method eliminates the abovementioned disadvantages. The invention is especially suitable for use in conjunction with the conversion of existing single-vessel digesters to include high temperatures in the upper part of the digester, for example hot black liquor impregnation in the concurrent zone. By use of the invention, the temperature in the upper part of the digester is easily controlled.

This is achieved by the method according to patent claim 1, which means that a constituent flow of liquor is led from the return line of the transfer circulation, is heated in one or more beating arrangements and is fed via one or more inlets into the digester at a location downstream of the outlet for the return line of the transfer circulation.

A further aspect of the invention is that there is a temperature difference between the transfer line at the inlet into the digester and the zone immediately downstream of said one or more inlets which temperature difference is more than 5° C., preferably more than 10° C., and still more preferably more than 15° C.

According to a further aspect of the invention, one or more additional liquids are added to said constituent flow before its addition to the digester. These liquids may constitute of black liquor which can be added to said constituent flow in a quantity in excess of 40%, preferably 50%, and more preferably 60%, of the total quantity of liquid, by means of a part of the black liquor which is extracted from the digester being recirculated to said constituent flow. Yet another possibility is that white liquor is added to said constituent flow. Naturally, both black liquor and white liquor or any other chemical which is beneficial for the cooking reslut can be added at the same time.

According to a further aspect of the invention, the first screen section which is arranged in the digester, downstream of said one or more inlets for the constituent flow, may be the extraction screen section for extraction of black liquor.

According to a further aspect of the invention, said one or more inlets for the constituent flow are situated less than 5 metres, preferably less than 3 metres and more preferably less than 1 metre downstream of said outlet for the return line.

One advantage of the invention is that a relatively high temperature can be achieved in the upper part of the digester, without the risk of steam production, flashing, in the high pressure feeder.

Another advantage is that the invention results in a greatly improved heat ecomony.

Another advantage is that the number of circulations, including screens can be reduced, since heating largely takes place externally, outside the digester.

When converting older, existing digesters, the present invention affords the possibility of achieving a uniform and selective cooling, with accompanying improved pulp quality. This is especially true in connection with the introduction of an extra circulation with white liquor charging and high flow in the countercurrent washing, by which means so-called isothermal cooking ITC™ in accordance with patent application SE 9203462 can be achieved.

DETAILED DESCRIPTION

Figure 1:
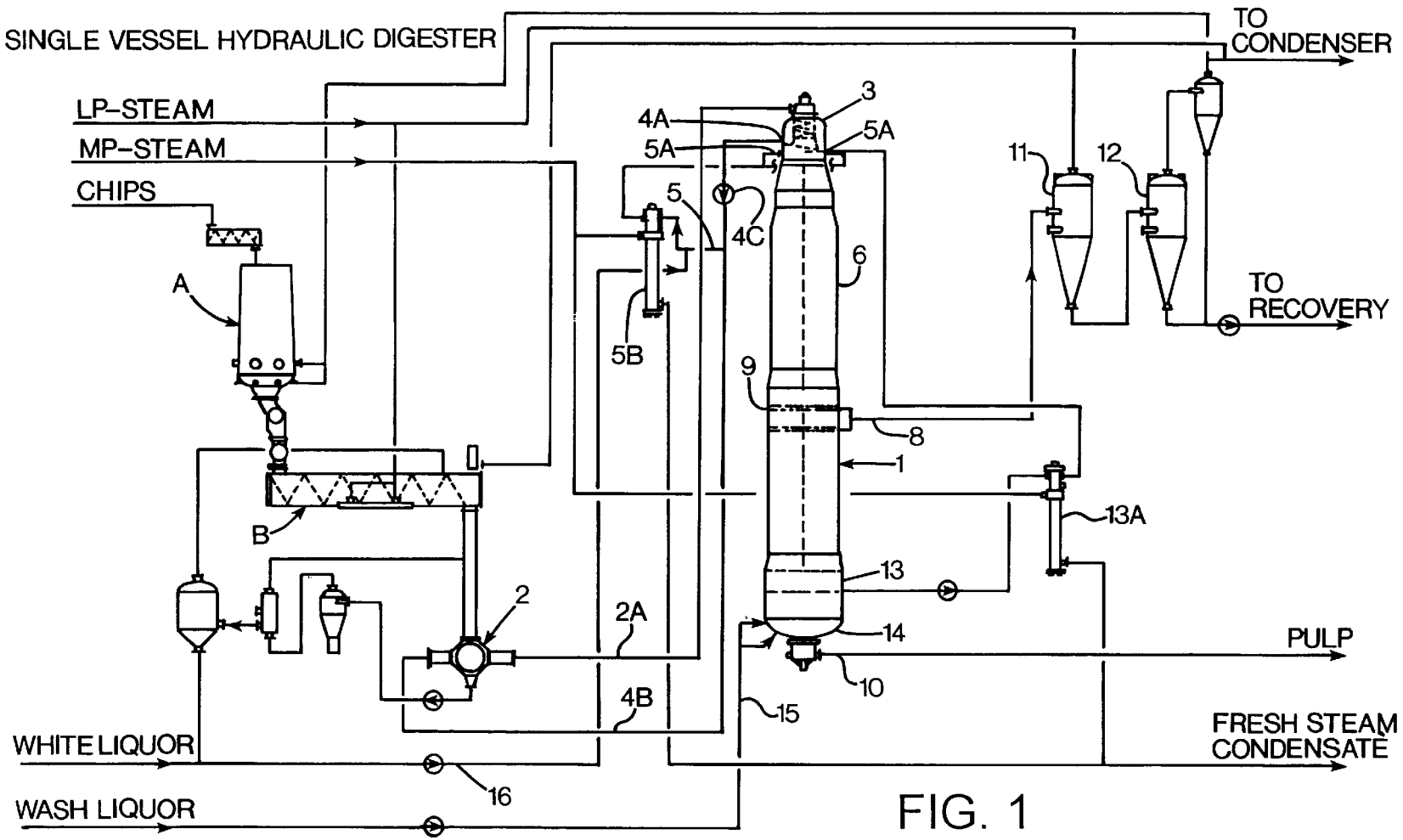
FIG. 1 is a schematic flow diagram of the hydraulic digester of the present invention.

The invention will be explained in greater detail hereinafter with reference to the drawing which is a diagrammatic representation of a preferred flow sheet for continuous cooking of fiber material in accordance with the present invention.

The installation shown in the figure comprises a chip bin (A), a horizontal steaming vessel (B) and a digester (1). The comminuted fiber material, which preferably consists of wood chips, is fed from the chip bin (A) in a known manner through the steaming vessel (B) to a high-pressure feeder (2). The function of the high-pressure feeder is to channel the chips from a relatively low pressure to a higher pressure of about 10 bar exclusive of static height difference. The chips, which are contained in a relatively cold liquid having a temperature of about 115° C., are fed from the high-pressure feeder through a transfer line (2A) up to the digester top (3) (see, for example, SE B 468053). At the digester top (3) there is a screen for separating off a certain amount of the liquid with which the chips are transported up to the top. This liquid is withdrawn from an outlet (4A) in the upper part of the digester and recirculated via a pump (4C), in a return line (4B) to the high-pressure feeder (2). In the return line (4B) there may be arranged a cooler if this is necessary in order to bring down the temperature of the liquor before it reaches the high pressure feeder. The lines (2A) and (4B), together with the high pressure feeder and the top separator in the digester, form a transfer circulation.

According to the invention a constituent flow of liquor (5) is led from the return line (4B). This constituent flow is heated in one or more heating arrangements (5B) and is fed via one or more inlets (SA) into the digester (1) at a location downstream of said outlet (4A) for the return line (4B).

The preferred embodiment according to the invention, as shown in the figure, demonstrates the use of a hydraulic digester which, in contrast to a steam/liquid phase digester, is hydraulically filled with liquid and therefore uses a downward feeding screw in the top screen for feeding the chips. The chips then move slowly downward with the chip column in a liquor-to-wood ratio which is about 2.0:1 to 10:1, preferably between 3:1 and 8:1 and even more preferably between 3.5:1 to 7:1. The liquid moves in this upper part concurrent to the chip column. Black liquor (8) is extracted from the digester at the extraction screen section (9) and is fed via a line to a first flash cyclone (11). A part of the black liquor may, according to one embodiment of the invention which is not shown in the drawing, be conveyed via a branch line, with the aid of a pump, to the said constituent liquor flow (5).

The zone above the extraction screen section (9) is called the cooking zone (6). In an alternative embodiment, there may be one or more cooking circulations located at a distance above the extraction screen section (9), in which case there is an impregnation zone above these cooking circulations. The object of the cooking circulations is to extract liquor which is then heated and re-introduced into the digester through a central pipe with an end opening at the same level as the corresponding screen section. There is also a possibility to add chemicals, for example white liquor or black liquor, in connection with the cooking circulations. In the case were black liquor is added to the top of the digester (via the constituent flow), in order to minimize the build-up of released material, a substantial part of the extracted liquor can be led away to a second flash cyclone (12) from which the liquor is led to recovery. The steam released from the second flash cyclone is used, as is customary, at another location in the system.

The temperature which is obtained in the cooking zone immediately below the one or more inlets (5) is about 120° C.–165° C., preferably 130°–160° C., and still more preferably 135°–160° C.

After a fairly long distance corresponding to a dwell time of about 2–4 hours, the chips have moved down to a level with the extraction screen section (9), which has already been mentioned above. This extraction screen section corresponds to the sort of extraction screen which is normally always arranged on a continuous digester. The greater part of this extracted liquid is thus conveyed to the first flash cyclone (II) and is thereafter conveyed onward for recovery. Below the level of the extraction screen section (9), the chip column enters a countercurrent cooking zone. The chips thus encounter cooking liquid which has been extracted at the lower screen section (13), has been heated in a lower heat exchanger (13A) and has been recirculated, with the aid of a pump, via a central pipe whose mouth opens out level with the screen section.

Washing liquid (15) is added at the lower end (14) of the digester, which washing liquid (15) thus moves in a conventional countercurrent manner and displaces hot liquor from the fiber material, and this permits subsequent cold blowing. The pulp is thereafter discharged through a feeding arrangement known per se and is led out through a line (10) for further processing.

In a preferred case, according to the invention, white liquor (16) is added at at least one position, that is to the said constituent flow (5). Additionally, white liquor may be added to the cooking circulations if such circulations are installed. It is of course also possible to add white liquor in the lower circulation (13) too, or in a retro-fitted circulation (not shown) immediately above the lower circulation (13), so that the alkali concentration is increased in the countercurrent zone, with approximately the same temperature expediently being maintained in all the cooking zones so that our patented ITC™ method is used.

The person skilled in the art will appreciate that the invention is not limited by what has been shown above, and instead can be varied within the scope of the patent claims which follow. An MCC layout is of course also conceivable to the person skilled in the art. Similarly, it is entirely possible to use the concept for cooking hardwood pulp too. In addition, the person skilled in the art will appreciate that a number of modifications can be made within the scope of the invention, such as, for example, selecting the exact temperature and alkali concentrations, etc. Further on, single-vessel steam phase digesters can also be used.

While the present invention has been described in accordance with preferred compositions and embodiments, it is to be understood that certain substitutions and alterations may be made thereto without departing from the spirit and scope of the following claims.

What is claimed is:

1. A method for continuous cooking of kraft pulp in a single vessel system, comprising:

(a) conveying chips and liquor in a transfer line from a high pressure feeder to a first end of a digester;

(b) separating a first portion of the liquor from the chips;

(c) withdrawing the first portion from an outlet being defined at an upper part of the digester;

(d) conveying the first portion in a return line to the high pressure feeder, the return line being in operative engagement with the digester at the outlet;

(e) cooking the chips in a concurrent cooking zone disposed in the digester;

(f) extracting black liquor from at least one extraction screen section disposed in the digester;

(g) discharging cooked pulp at a second end of the digester, the second end being opposite the first end;

(h) conducting a constituent flow of liquor away from the return line;

(i) heating the constituent flow of liquor in a heating arrangement; and (j) feeding the constituent flow of liquor via an inlet into the digester at a location that is downstream of the outlet at the upper part of the digester.

2. The method according to claim 1, wherein the method further comprising providing the chips and liquid conveyed in the transfer line with a first temperature, providing liquid and chips disposed in a zone that is located immediately downstream of the inlet with a second temperature, the difference between the first temperature and the second temperature is more than 5 degrees Celsius.

3. The method according to claim 2 wherein the difference is more than 10 degrees Celsius.

4. The method according to claim 2 wherein the difference is more than 15 degrees Celsius.

5. The method according to claim 1 wherein method further comprises adding a second liquid to the constituent flow of liquor prior to feeding the constituent flow of liquor into the digester.

6. The method according to claim wherein the method further comprises extracting a black liquor from the digester and recirculating a portion of the black liquor to the constituent flow of liquor so that the black liquor accounts for over 40% of the constituent flow of liquor.

7. The method according to claim 6 wherein the black liquor accounts for about 50% of the constituent flow of liquor.

8. The method according to claim 6 wherein the black liquor accounts for about 60% of the constituent flow of liquor.

9. The method according to claim 1 wherein the method further comprises adding a white liquor to the constituent flow of liquor.

* * * * *